US007422467B2

(12) United States Patent
Siev et al.

(10) Patent No.: US 7,422,467 B2
(45) Date of Patent: Sep. 9, 2008

(54) BALANCED INTERCONNECTOR

(75) Inventors: Virak Siev, Pointe-Claire (CA); Antoine Pelletier, Ville Lasalle (CA)

(73) Assignee: Belden CDT (Canada), Inc., Pointe-Claire (CA)

( * ) Notice: Subject to any disclaimer, the term of this patent is extended or adjusted under 35 U.S.C. 154(b) by 0 days.

(21) Appl. No.: 11/740,154

(22) Filed: Apr. 25, 2007

(65) Prior Publication Data

US 2008/0003877 A1 Jan. 3, 2008

Related U.S. Application Data

(63) Continuation-in-part of application No. PCT/CA2005/001753, filed on Nov. 17, 2005.

(60) Provisional application No. 60/628,136, filed on Nov. 17, 2004, provisional application No. 60/745,563, filed on Apr. 25, 2006.

(30) Foreign Application Priority Data

Nov. 17, 2004 (CA) ..... 2487760
Apr. 25, 2006 (CA) ..... 2544929

(51) Int. Cl.
*H01R 4/24* (2006.01)

(52) U.S. Cl. ..... 439/404; 439/405; 439/941

(58) Field of Classification Search ..... 439/403, 439/404, 405, 676, 941
See application file for complete search history.

(56) References Cited

U.S. PATENT DOCUMENTS 5,186,647 A 2/1993 Denkmann et al.
5,967,853 A 10/1999 Hashim
5,997,358 A 12/1999 Adriaenssens et al.
6,045,391 A 4/2000 Jaag
6,116,965 A 9/2000 Arnett et al.
6,126,476 A 10/2000 Viklund et al.
6,150,612 A 11/2000 Grandy et al.
6,193,526 B1 2/2001 Milner et al.
6,238,231 B1 5/2001 Chapman et al.
6,280,231 B1 8/2001 Nicholls
6,309,240 B1 10/2001 Daoud
6,582,247 B2 6/2003 Siemon
6,596,944 B1 7/2003 Clark et al.
6,648,670 B1 11/2003 Chen
6,794,570 B2 9/2004 Chou (Continued)

FOREIGN PATENT DOCUMENTS

CA 1176330 B1 10/1984

(Continued)

*Primary Examiner*—Khiem Nguyen
(74) *Attorney, Agent, or Firm*—Goudreau Gage Dubuc

(57) ABSTRACT

There is disclosed a balanced interconnector comprising first and second like connecting elements, each of the connecting elements comprising an elongate center section and a pair of parallel IDCs opening in substantially opposite directions, the IDCs attached substantially at right angles to and at opposite ends of the elongate center sections, each of the connecting elements lying in different parallel plains. The first and second connecting elements are arranged such that the elongate center sections are opposite one another and the IDCs of the first connecting element are not opposite the IDCs of the second connecting element. In a particular embodiment the connecting elements of adjacent pairs of connecting elements are at right angles. The positioning and geometry of the connecting elements.

29 Claims, 18 Drawing Sheets

U.S. PATENT DOCUMENTS

| | | | |
|---|---|---|---|
| 7,168,993 | B2 | 1/2007 | Hashim |
| 7,179,115 | B2 | 2/2007 | Hashim |
| 7,186,148 | B2 | 3/2007 | Hashim |
| 7,186,149 | B2 | 3/2007 | Hashim |
| 7,190,594 | B2 | 3/2007 | Hashim et al. |
| 7,201,618 | B2 | 4/2007 | Ellis et al. |
| 2005/0136729 | A1 | 6/2005 | Redfield et al. |
| 2005/0195584 | A1 | 9/2005 | AbuGhazaleh et al. |
| 2006/0154531 | A1 | 7/2006 | Kim et al. |
| 2006/0160428 | A1 | 7/2006 | Hashim |
| 2006/0292920 | A1 | 12/2006 | Hashim et al. |

FOREIGN PATENT DOCUMENTS

| | | | |
|---|---|---|---|
| CA | 2486596 | A1 | 5/2005 |
| EP | 0 899 827 | A2 | 3/1999 |
| FR | 2 600 825 | A1 | 7/2006 |
| JP | 11233205 | | 8/1999 |
| WO | WO-02/15339 | A1 | 2/2002 |
| WO | WO-2005/117200 | A1 | 12/2005 |
| WO | WO-2006/132972 | A1 | 12/2006 |

BALANCED INTERCONNECTOR

CROSS REFERENCE TO RELATED APPLICATIONS

This application is a Continuation-In-Part (CIP) application of PCT Application No. PCT/CA2005/001753 filed on Nov. 17, 2005 designating the United States and published in English under PCT Article 21(2), which itself claims priority on U.S. Provisional Application No. 60/628,136 filed on Nov. 17, 2004 and Canadian Patent Application No. 2,487,760 also filed on Nov. 17, 2004.

This application also claims priority on U.S. Provisional Application No. 60/745,563 filed on Apr. 25, 2006 and Canadian Patent Application No. 2,544,929 also filed on Apr. 25, 2006.

All documents cited above are herein incorporated by reference.

BACKGROUND

In data transmission networks, cross-connect connectors (such as BIX, 110, 210, etc.) are commonly used in telecommunication rooms to interconnect the ends of telecommunications cables, thereby facilitating network maintenance. For example, the prior art reveals cross connectors comprised of a series of isolated flat straight conductors each comprised of a pair of reversed Insulation Displacement Contact (IDC) connectors connected end to end for interconnecting a conductor of a first cable with the conductors of a second cable.

As known in the art, all conductors transmitting signals act as antennas and radiate the signal they are carrying into their general vicinity. Other receiving conductors will receive the radiated signals as crosstalk. Cross talk typically adversely affects signals being carried by the receiving conductor and must be dealt with if the strength of the received crosstalk exceeds certain predetermined minimum values. The strength of received cross talk is dependant on the capacitive coupling between the transmitting conductor and the receiving conductor which is influenced by a number of mechanical factors, such as conductor geometry and spacing between the conductors, as well the frequency of the signals being carried by the conductors, shielding of the conductors, etc. As signal frequency increases, the influence of even quite small values of capacitive coupling can give rise to significant cross talk having a deleterious effect on signal transmission.

Systems designed for the transmission of high frequency signals, such as the ubiquitous four twisted pair cables conforming to ANSI/EIA 568, take advantage of a variety of mechanisms to minimise the capacitive coupling between conductors both within and between cables. One problem with such systems is that, although coupling, and therefore crosstalk, is reduced within the cable runs, conductors within the cables must inevitably be terminated, for example at device or cross connector. These terminations introduce irregularities into the system where coupling, and therefore cross talk, is increased. With the introduction of Category 6 and Augmented Category 6 standards and the 10 GBase-T transmission protocol, the allowable levels for all kinds of internal and external crosstalk, including Near End Crosstalk (NEXT), Far End Crosstalk (FEXT) and Alien Crosstalk, have been lowered. As a result, the prior art connectors and interconnectors are generally no longer able to meet the allowable levels for cross talk.

Additionally, although long cable elements such as the twisted pairs of conductors achieve good crosstalk characteristics through appropriate twisting and spacing of the pairs of conductors, when viewed as a whole, the cable is subject to additional crosstalk at every irregularity. Such irregularities occur primarily at connectors or interconnectors and typically lead to an aggressive generation of crosstalk between neighbouring pairs of conductors which in turn degrades the high frequency bandwidth and limits data throughput over the conductors. As the transmission frequencies continue to increase, each additional irregularity at local level, although small, adds to a collective irregularity which may have a considerable impact on the transmission performance of the cable. In particular, unraveling the ends of the twisted pairs of conductors in order to introduce them into an IDC type connections introduces capacitive coupling between the twisted pairs.

SUMMARY OF THE INVENTION

In order to address the above and other drawbacks, there is provided a connector for terminating two pairs of conductors. The connector comprises first and second pairs of elongate terminals, each of the terminal pairs terminating a respective one of the pairs of conductors, each of the first pair of terminals arranged substantially in parallel to and substantially equidistant from a first plane and each of the second pair of terminals arranged substantially in parallel to and substantially equidistant from a second plane at right angles to the first plane, the first plane intersecting the second plane substantially at right angles along a line of intersection substantially in parallel to each of the first and second terminal pairs. When viewed transversely, a first distance between a first terminal of the first terminal pair and a first terminal of the second terminal pair is less than a second distance between the first terminal of the first terminal pair and a second terminal of the second terminal pair and a third distance between a second terminal of the first terminal pair and the first terminal of the second terminal pair is less than a fourth distance between the second terminal of the first terminal pair and the second terminal of the second terminal pair.

There is also provided an interconnector for interconnecting a first set of two pairs of conductors with a second set of two pairs of conductors. The interconnector comprises a non conductive housing comprising a first outer surface and a second outer surface, and at least two pairs of like conducting elements, each element of each of the pairs comprising an elongate terminal at opposite first and second ends thereof, the terminals generally parallel and non-collinear, the terminals at the first ends for receiving a respective one of the first set of conductors and the terminals at the second ends for receiving a respective one of the second set of conductors. The elements of a first of the pairs lie on either side of a first plane and are arranged opposite one another as a reverse mirror image, wherein the elements of a second of the pairs lie on either side of a second plane and are arranged opposite one another as a reverse mirror image and wherein the first plane intersects the second plane at right angles along a first line of intersection which is parallel to the elongate terminals. At least a portion of each of the terminals at the first element ends are exposed on the first surface and at least a portion of each of the terminals at the second element ends are exposed on the second surface.

Furthermore, there is provided an interconnector for interconnecting a first cable comprising four twisted pairs of conductors with a second cable comprising four twisted pairs of conductors. The interconnector comprises a non conductive housing comprising a first outer surface and a second outer surface, and first, second, third and fourth pairs of like conducting connecting elements, each element of a given one of the pairs of elements comprising an elongate terminal at opposite first and second ends thereof, the terminals substantially parallel and non-collinear and adapted to receive a respective one of the conductors wherein each element of the given pair lies in a different plane and wherein a first element of the given pair is arranged opposite a second element of the given pair as a reverse mirror image. A first element of the first pair and a first element of the second pair lie in a first plane, a second element of the first pair and a second element of the second pair lie in a second plane, a first element of the third pair and a first element of the fourth pair lie in a third plane and a second element of the third pair and a second element of the fourth pair lie in a fourth plane and further wherein at least a portion of each of the terminals at the first ends is exposed on the first outer surface and at least a portion of each of the terminals at the second ends is exposed on the second outer surface.

Additionally, there is provided an interconnection between a first set of two pairs of conductors and a second set of two pairs of conductors. The interconnection comprises first and second pairs of like elongate connecting elements, a first end of each of the first pair of elements connected to a respective one of a first pair of the first set of pairs of conductors, a second end of each of the first pair of elements connected to a respective one of a first pair of the second set of pairs of conductors, a first end of each of the second pair of elements connected to a respective one of a second pair of the first set of pairs of conductors, and a second end of each of the second pair of elements connected to a respective one of a second pair of the second set of pairs of conductors, and a first capacitor connected between a first element of the first pair and a first element of the second pair, a second capacitor connected between a first element of the first pair and a second element of the second pair, a third capacitor connected between a second element of the first pair and a first element of the second pair, and a fourth capacitor connected between a second element of the first pair and a second element of the second pair. The capacitors have a capacitive value which is substantially equal.

Also, there is provided a method of interconnecting first and second conductors of a first pair of conductors respectively with first and second conductors of a second pair of conductors and first and second conductors of a third pair of conductors respectively with first and second conductors of fourth second pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same. The method comprises providing first and second interconnecting elements, providing a first capacitor having a capacitive value substantially the same as the parasitic capacitances, coupling the first and second elements with the first capacitor, interconnecting the first element between the first conductor of the first pair of conductors and the first conductor of the second pair of conductors and the second element between the first conductor of the third pair of conductors and the first conductor of the fourth pair of conductors, providing third and fourth interconnecting elements, providing a second capacitor having a capacitive value substantially the same as the parasitic capacitances, coupling the third and fourth elements with the second capacitor, interconnecting the third element between the second conductor of the first pair of conductors and the second conductor of the second pair of conductors and the fourth element between the second conductor of the third pair of conductors and the second conductor of the fourth pair of conductors.

Additionally, there is disclosed an interconnector for interconnecting first and second conductors of a first pair of conductors with first and second conductors of a second pair of conductors and first and second conductors of a third twisted pair of conductors with first and second conductors of a fourth twisted pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same. The interconnector comprises first and second Tip elements, the first Tip element interconnected between the first conductor of the first pair of conductors and the first conductor of the second pair of conductors and the second Tip element interconnected between the first conductor of the third pair of conductors and the first conductor of the fourth pair of conductors, first and second Ring elements, the first Ring element interconnected between the second conductor of the first pair of conductors and the second conductor of the second pair of conductors and the second Ring element interconnected between the second conductor of the third pair of conductors and the second conductor of the fourth pair of conductors, and first and second capacitors between respectively the first and second Tip elements and the first and second Ring elements. Each of the capacitors is substantially equal to the first and second parasitic capacitances.

There is also provided an interconnection panel for interconnecting a first plurality of cables with a second plurality of cables, each of the cables comprising at least two pairs of conductors. The panel comprises a plurality of interconnectors arranged in a row, each of the interconnectors adapted to interconnect a respective cable of the first plurality of cables with a respective cable of the second plurality of cables. Each of the interconnectors comprises a non conductive housing comprising a first outer surface and a second outer surface, and at least two pairs of like conducting elements, each element of each of the pairs comprising an elongate terminal at opposite first and second ends thereof, the terminals generally parallel and non-collinear, the terminals at the first ends for receiving a respective one of the conductors of the respective one of the first plurality of cables and the terminals at the second ends for receiving a respective one of the conductors of the respective one of the second plurality of cables. The elements of a first of the pairs lie on either side of a first plane arranged opposite one another as a reverse mirror image, wherein the elements of a second of the pairs lie on either side of a second plane arranged opposite one another as a reverse mirror image and wherein the first plane intersects the second plane at right angles along a first line of intersection which is parallel to the elongate terminals. At least a portion of each of the terminals at the first element ends are exposed on the first surface and at least a portion of each of the terminals at the second element ends are exposed on the second surface.

BRIEF DESCRIPTION OF THE FIGURES

FIG. 12(*b*) is a schematic diagram of the parasitic capacitances arising with the connecting elements of FIG. 12(*a*);

FIG. 12(*c*) is a schematic diagram of the parasitic capacitances arising between all the connecting elements within an interconnector in accordance with an alternative illustrative embodiment of the present invention;

FIG. 13(*b*) is a schematic diagram of the inherent capacitances of FIG. 13(*a*);

FIG. 14(*b*) is a top plan view detailing the relative placement of the connecting elements of adjacent interconnectors in accordance with an alternative illustrative embodiment of the present invention.

DETAILED DESCRIPTION OF THE ILLUSTRATIVE EMBODIMENTS

Figure 1:
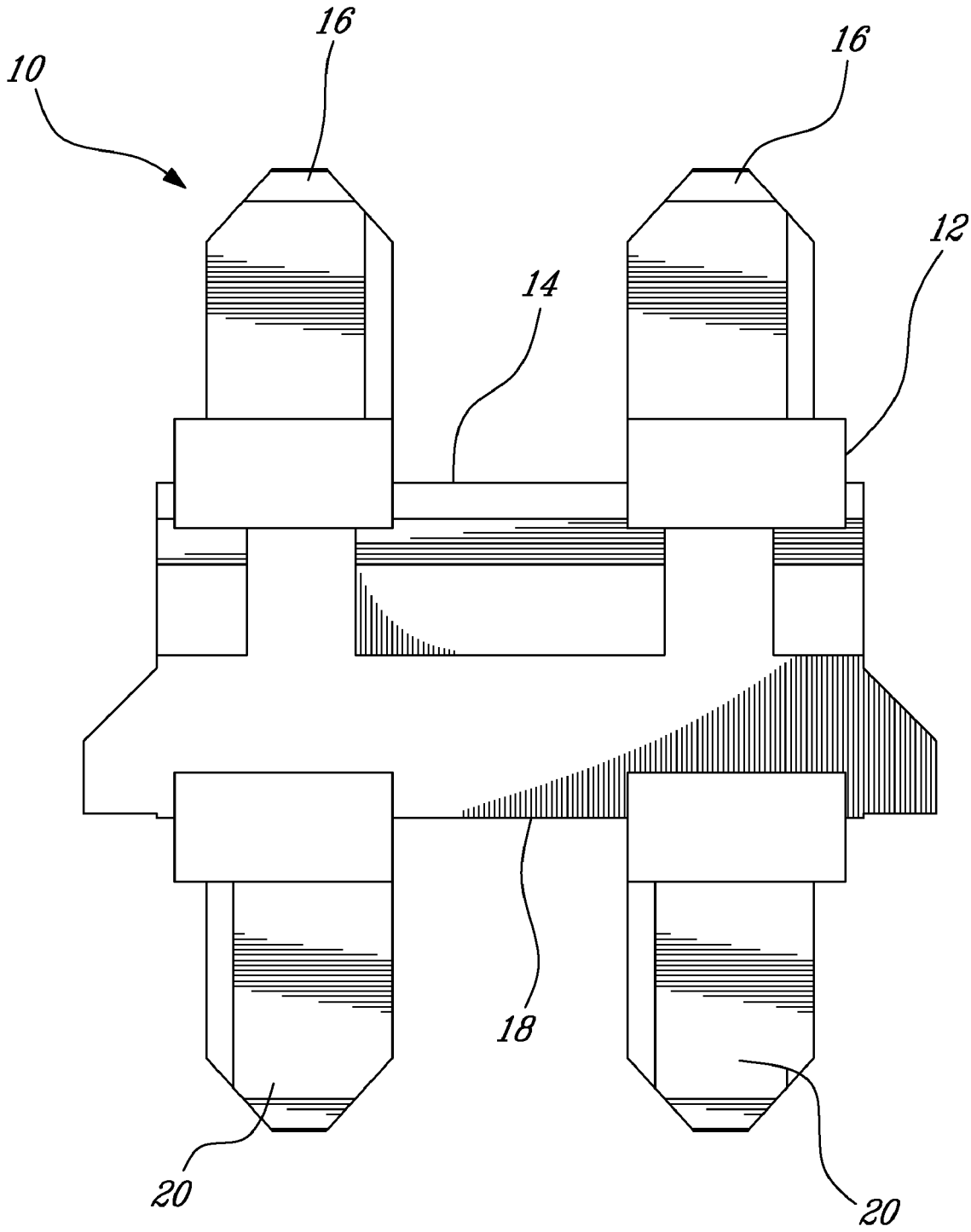
FIG. 1 is a side plan view of a balanced interconnector in accordance with an illustrative embodiment of the present invention.
Figure 2:
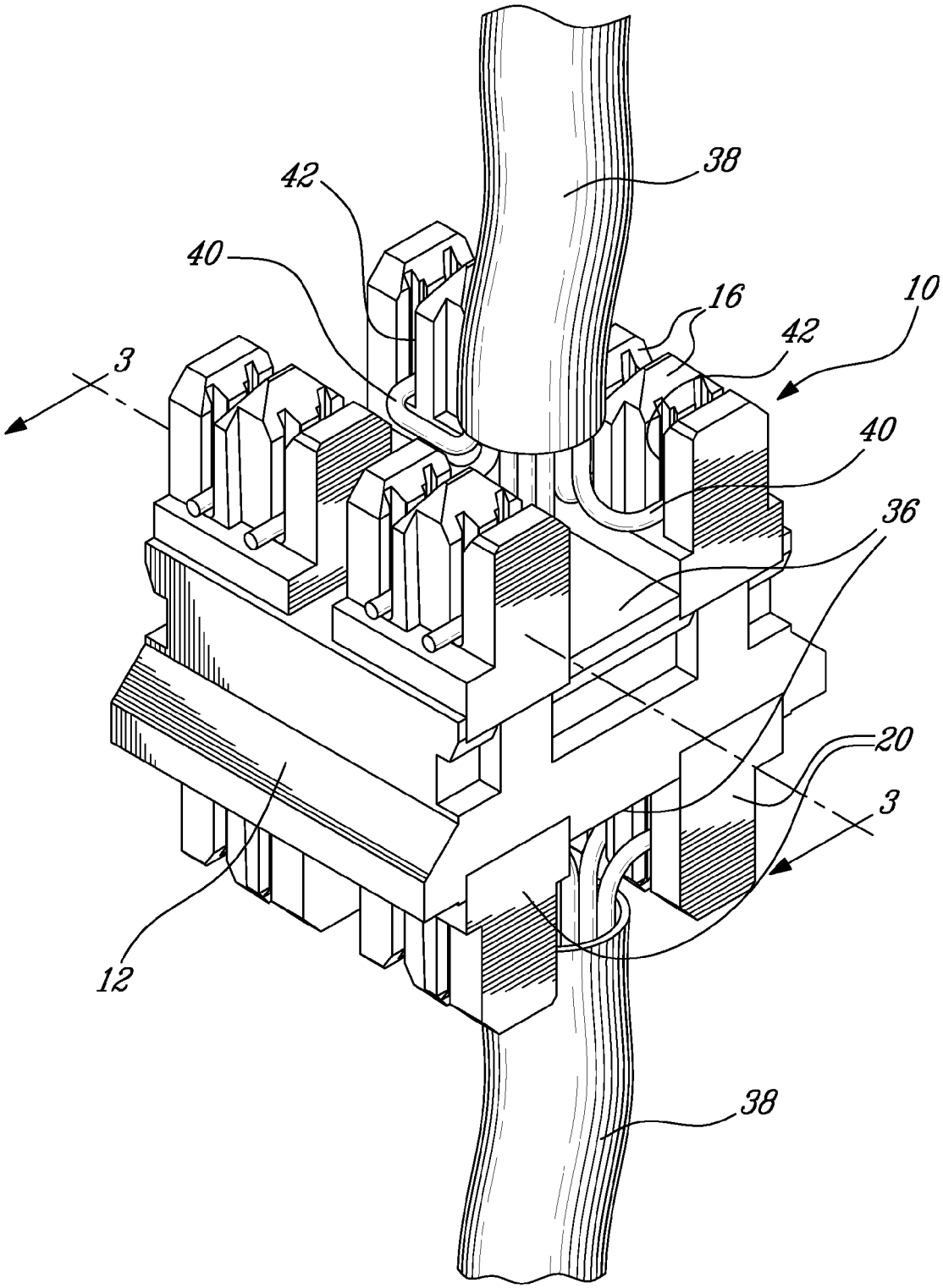
FIG. 2 is a right raised perspective view of a balanced interconnector in accordance with an illustrative embodiment of the present invention.

Referring now to FIGS. 1 and 2, a balanced interconnector, generally referred to using the reference numeral 10, will now be described. The interconnector 10 comprises an insulating housing 12 comprising a first outer surface 14 into which a first set of turrets as in 16 are moulded and a second outer surface 18 into which a second set of turrets as in 20 are moulded. Note that although first outer surface 14 and the second outer surface 18 are shown as being relatively flat and opposed, in a particular embodiment the surfaces could be at an angle to one another, or could be of uneven height such that the turrets as in 16, 20 have different relative heights.

Figure 3:
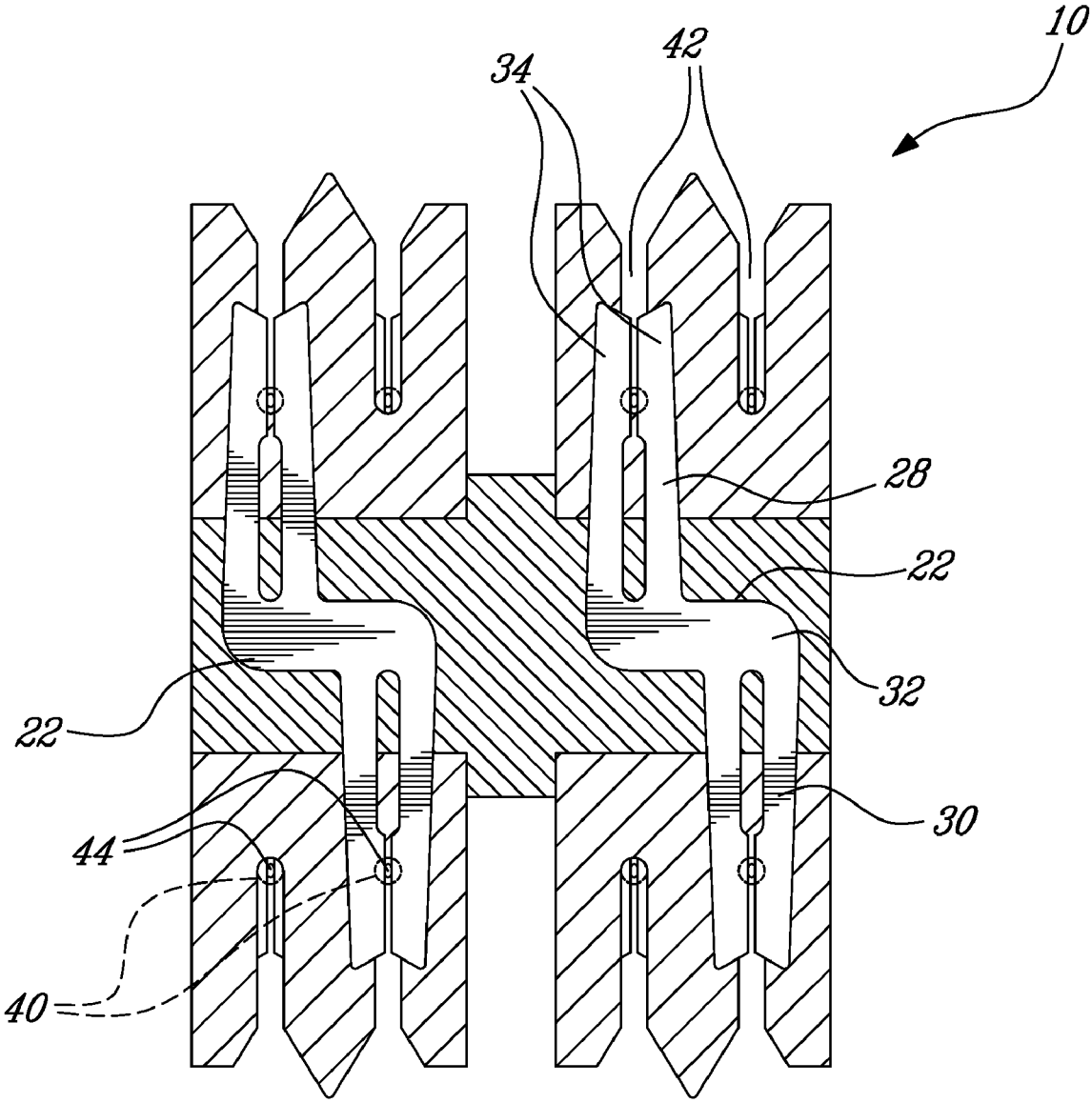
FIG. 3 is a sectional view of a balanced interconnector taken along line 3-3 in FIG. 2.
Figure 4:
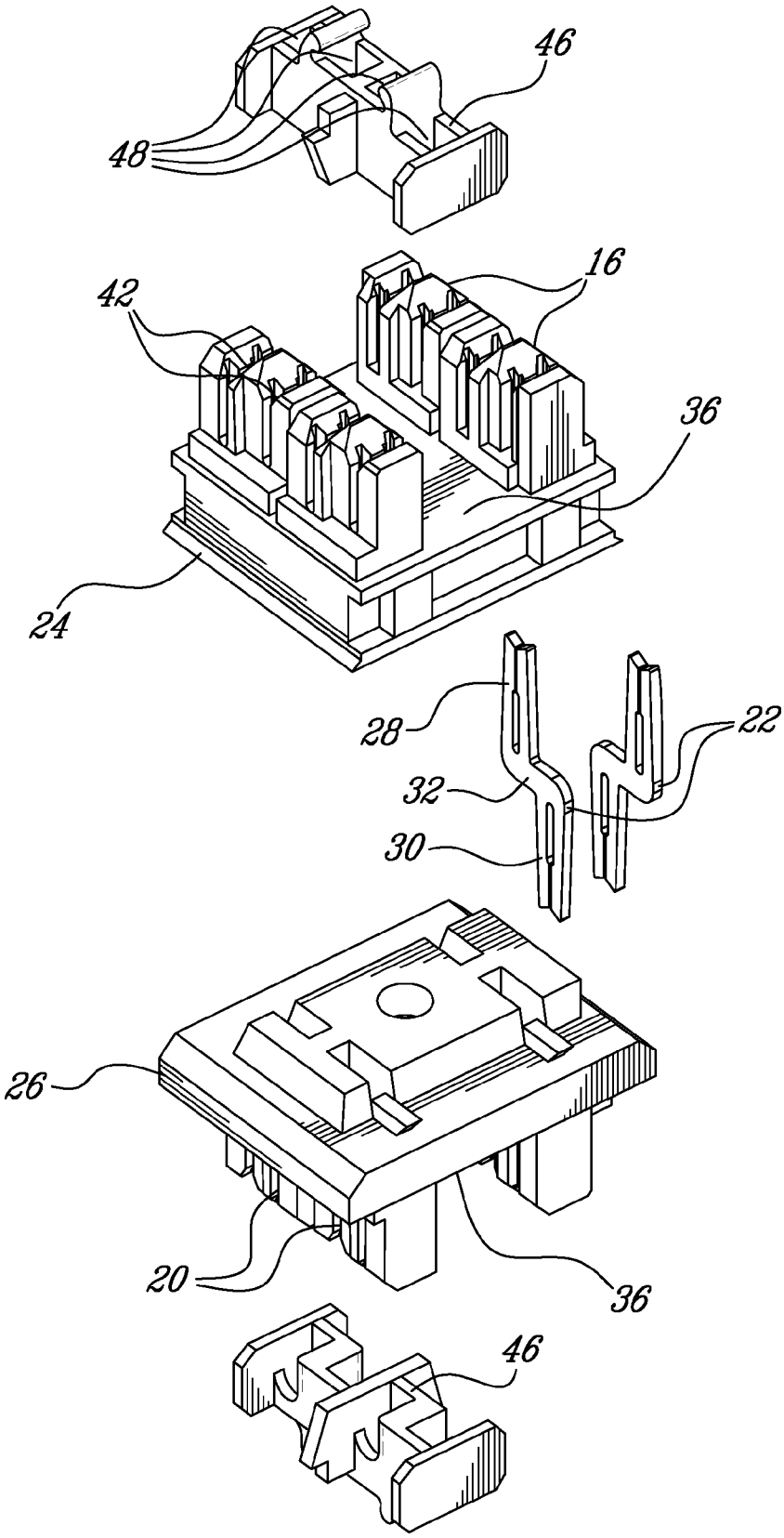
FIG. 4 is an exploded view of a balanced interconnector in accordance with an illustrative embodiment of the present invention.

Referring now to FIGS. 3 and 4 in addition to FIGS. 1 and 2, a series of connecting elements as in 22 which extend from one of the first set of turrets as in 16 to a corresponding one of the second set of turrets as in 20 are imbedded in the housing 12. In this regard, the housing 12 is typically manufactured in first and second interconnecting parts 24, 26 thereby providing a simple means for assembling the connecting elements as in 22 within the housing 12. Each connecting element 22 is comprised of a pair of opposed terminals 28, 30, Illustratively elongate with each terminal arranged along parallel non-collinear axes. The terminals 28, 30 are illustratively bifurcated Insulation Displacement Connectors (IDCs), interconnected by an elongate connecting portion 32 at an angle to the terminals as in 28, 30. Illustratively, the angle between the terminals 28, 30 and the elongate connecting portion 32 is shown as being a right angle.

As known in the art, the IDCs as in 28, 30 are each comprised of a pair of opposed insulation displacing blades as in 34. Each connecting element 22 is illustratively stamped from a flat conducting material such as nickel plated steel, although in a particular embodiment the connecting element 22 could be formed in a number of ways, for example as an etched trace on a Printed Circuit Board (PCB) or the like.

Still referring to FIGS. 1 through 4, the first set of turrets as in 16 and the second set of turrets as in 20 are each arranged in two parallel rows of turrets defining a cable end receiving region 36 there between for receiving a cable end 38. The insulated conductors as in 40 (typically arranged in twisted pairs of conductors) exit the cable end 38 and are received by conductor receiving slots 38 moulded in each of the turrets as in 16 or 20. As known in the art, the insulated conductors as in 40 are inserted into their respective slots as in 42 using a special "punch down" tool (not shown) which simultaneously forces the conductor as in 40 between the bifurcated IDC, thereby interconnecting the conductive center 44 of the insulated conductor 34 with the IDC as in 24, 26, while cutting the end of the conductor 40 (typically flush with the outer edge of the turret in question).

As known in the art, the insulated conductors as in 40 are typically arranged into colour coded twisted pairs of conductors, and often referred to as Tip and Ring. In twisted pair wiring, the non-inverting wire of each pair is often referred to as the Ring and comprises an outer insulation having a solid colour, while the inverting wire is often referred to as the Tip and comprises a white outer insulation including a coloured stripe.

Figure 5:
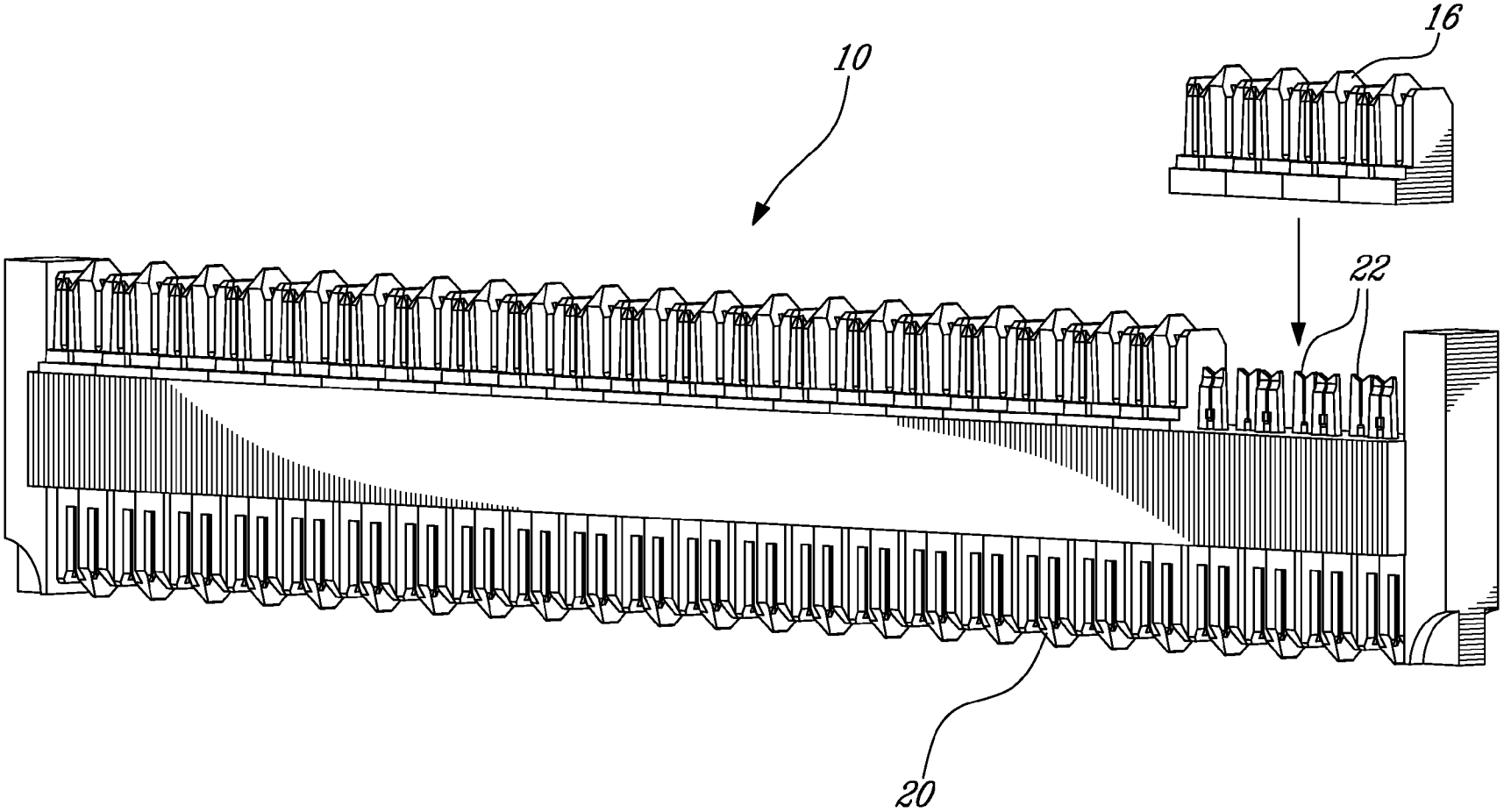
FIG. 5 is a partially disassembled right front perspective view of a balanced interconnector in accordance with an alternative illustrative embodiment of the present invention.

Note that although the first set of turrets 16 and the second set of turrets as in 20 in the above illustrative embodiment are each shown as being arranged in two (2) parallel rows of turrets, in a particular embodiment the first set of turrets 16 and the second set of turrets as in 20 could be arranged in a single row, alternatively also together with others, to form the inline cross connector as illustrated in FIG. 5. Additionally, systems other than IDCs could be used for interconnecting the insulated conductors as in 40 with their respective connecting elements as in 22.

Referring now to FIGS. 2 and 4, in a particular embodiment a wire lead guide as in 46, comprised of a plurality of conductor guiding channels as in 48 moulded therein and adapted to fit snugly into the cable end receiving regions as in 36, can be interposed between the cable end 38 and the conductor receiving slots 42 moulded in each of the turrets as in 16 or 20.

Figure 6:
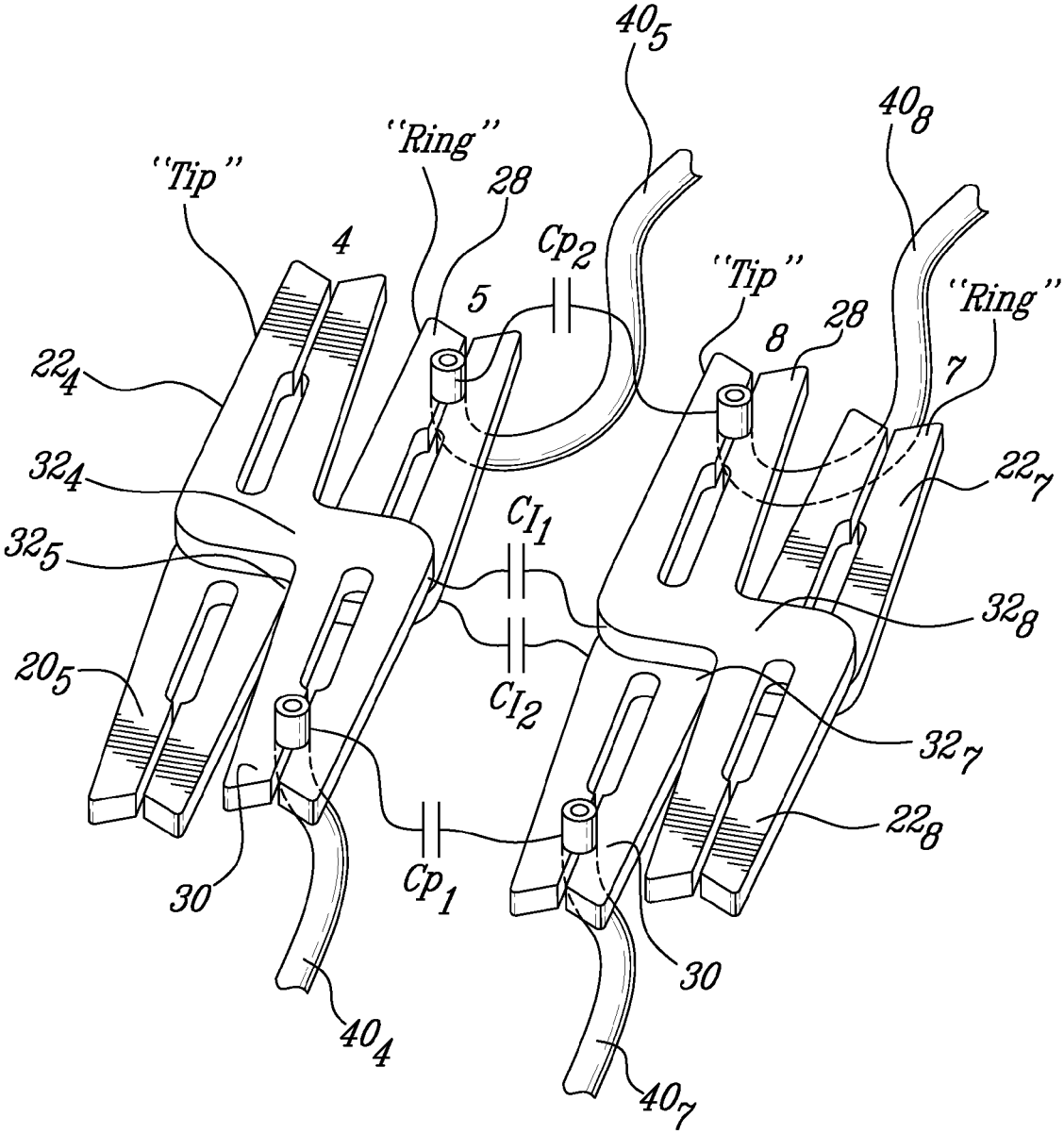
FIG. 6 is right lowered perspective view of two pairs of connecting elements in accordance with an illustrative embodiment of the present invention.

Referring now to FIGS. 2 and 6, as discussed above the first set of turrets as in 16 and the second set of turrets as in 20 are each arranged in two parallel rows of turrets. As a result, four (4) connecting elements as in 22 are illustratively arranged on each side of the cable end receiving region 36, each comprising two (2) pairs of interconnectors. Illustratively, on a first side of the cable end receiving region 36 four (4) connecting elements $\mathbf{22}_4$, $\mathbf{22}_8$ and $\mathbf{22}_5$, $\mathbf{22}_7$ each terminate a respective conductor as in 44 (illustratively the interconnectors are indicated as terminating conductors 4, 8, 5 and 7 of the twisted pairs of conductors).

Figure 7:
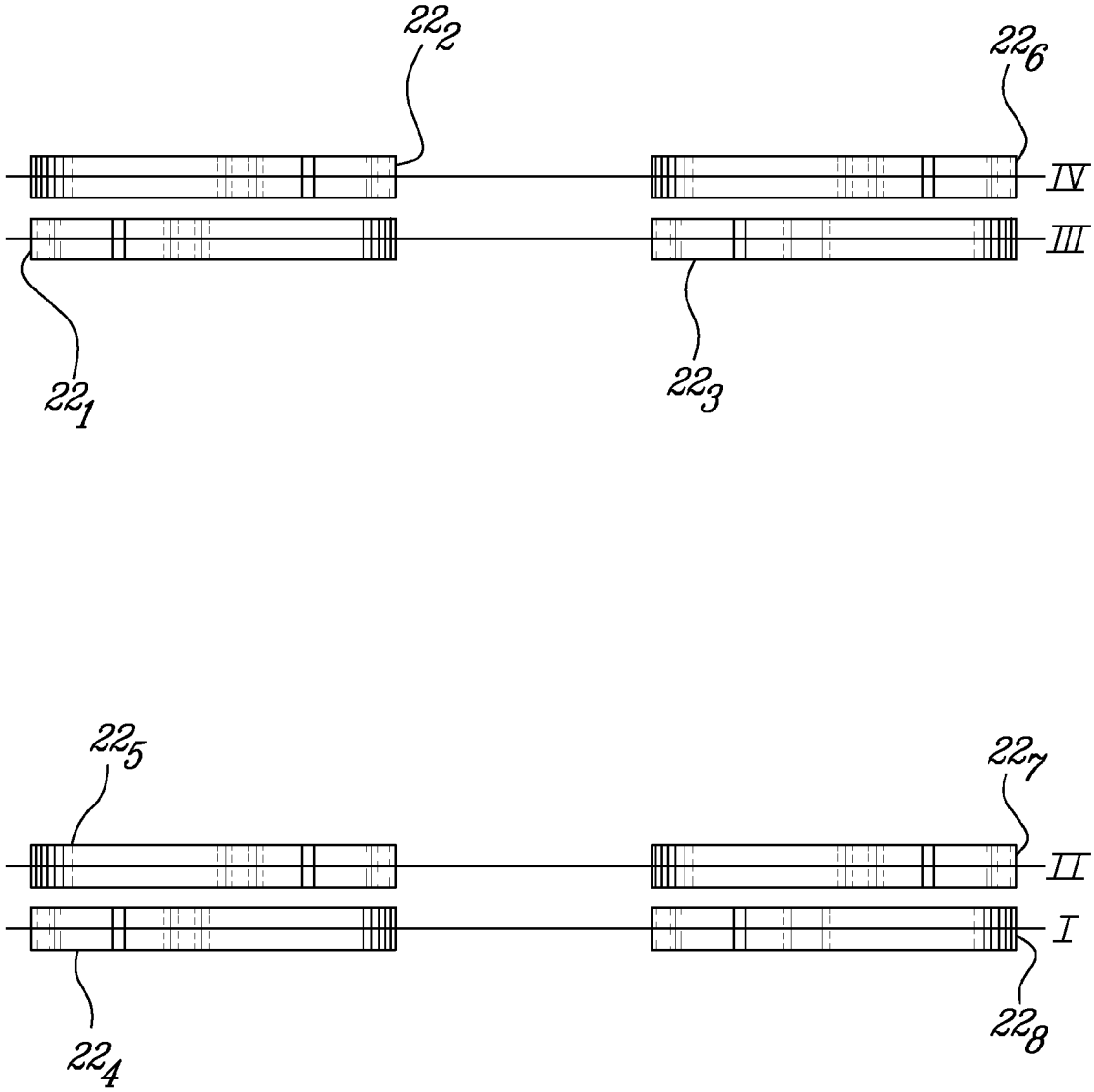
FIG. 7 is a top plan view of four pairs of connecting elements in accordance with an illustrative embodiment of the present invention.
Figure 8:
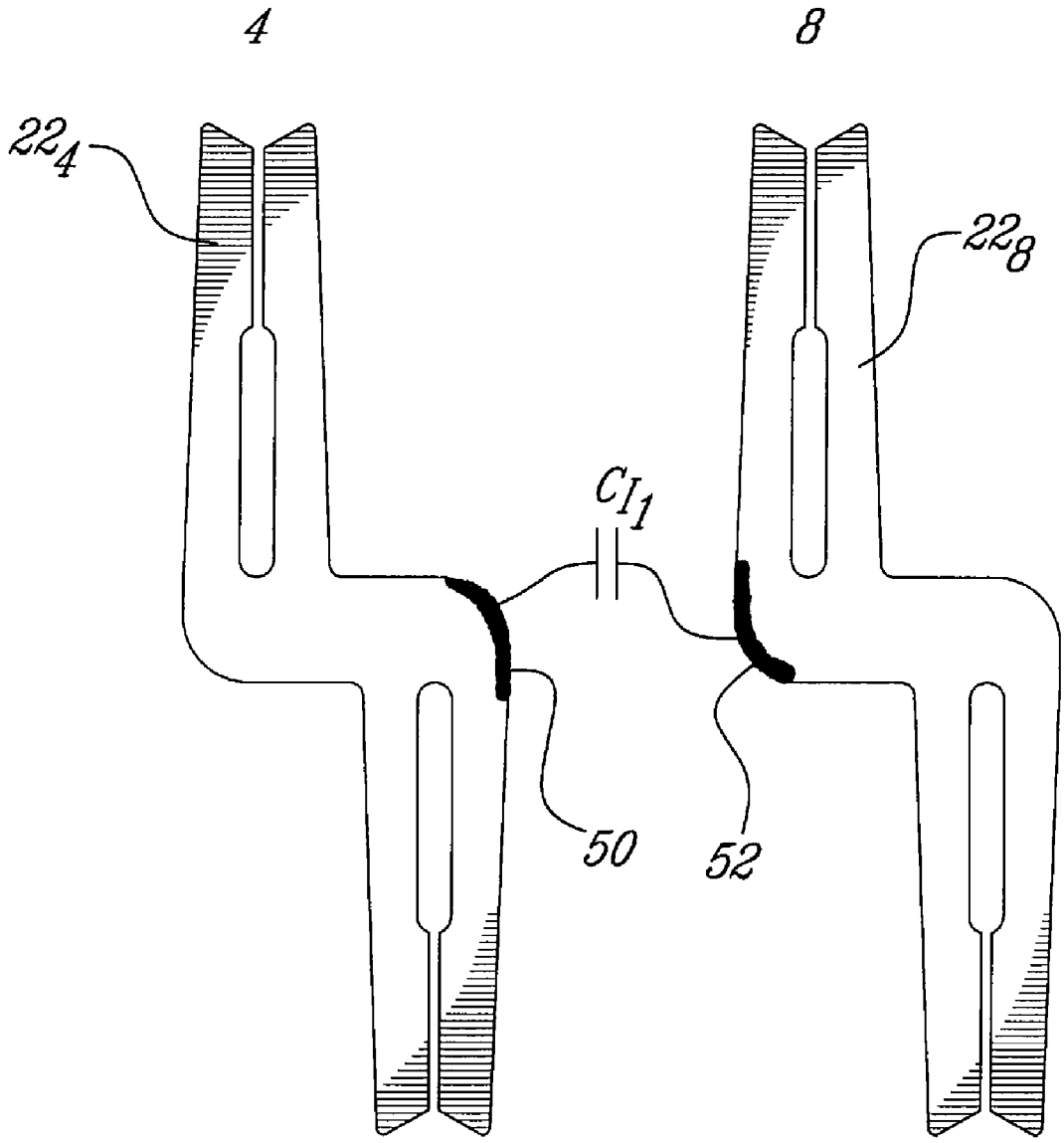
FIG. 8 is a side plane view of a pair of adjacent connecting elements in accordance with an illustrative embodiment of the present invention.

Referring now to FIG. 7, the "Tip" connecting elements $\mathbf{22}_4$, $\mathbf{22}_8$ of each interconnector pair lie in a first plane "I" and the "Ring" connecting elements $\mathbf{22}_5$, $\mathbf{22}_7$ lie in a second plane "II". Similarly, the "Tip" connecting elements $\mathbf{22}_1$, $\mathbf{22}_3$ each lie in a third plane "III" and the "Ring" connecting elements $\mathbf{22}_2$, $\mathbf{22}_6$ lie in a fourth plane "IV" parallel to yet displaced from the first plain. All planes are parallel and displaced from one another. Note that, notwithstanding the above designation of certain connecting elements as in 22 being Tip elements and others being Rings elements, a person of skill in the art will understand that a Tip element of a Tip and Ring pair could be used to terminate either a Ring or Tip of a conductor pair with the Ring element of the Tip and Ring pair terminating the other.

Referring back to FIG. 6 in addition to FIG. 7, the direction of the elongate connecting portions $\mathbf{32}_4$, $\mathbf{32}_8$ of the first pair of connecting elements $\mathbf{22}_4$, $\mathbf{22}_8$ is opposite to that of the elongate connecting portion $\mathbf{32}_5$, $\mathbf{32}_7$ of the second pair of connecting elements $\mathbf{22}_5$, $\mathbf{22}_7$ such that the Tip and Ring connecting elements terminating a given twisted pair are arranged opposite one another as a reverse mirror image.

Still Referring to FIGS. 6 and 7, although the connecting elements as in 22 are not interconnected directly with one another, given the relative proximity of adjacent connecting elements as in 22 to one another, unraveling the ends of the cables 38 in order to insert the conductors as in 40 into their respective IDCs as in 28, 30 gives rise to a parasitic coupling (illustrated by capacitive elements $C_{P1}$ and $C_{P2}$) between the conductors as in 40, with the effect being the greatest for those which are closest (illustratively conductors marked 4-7 and conductors marked 5-8). As known in the art, especially at high frequencies such coupling, although small, can have a large detrimental effect on a transmitted signal. In particular, in the illustrated case differential signals travelling on the pair of conductors marked 7-8 give rise to differential signals on the pair of conductors marked 4-5 and vice versa. The is effect is counteracted by the positioning of the interconnectors in the manner shown which gives rise to an inherent coupling (illustrated by first and second capacitive elements $C_{I1}$ and $C_{I2}$) between connecting elements as in 22 lying in the same plane. Indeed, referring to the first capacitive element $C_{I1}$, for example, an outer edge 50 of connecting element $\mathbf{22}_4$ provides a first electrode of the first capacitive element $C_{I1}$, an outer edge 52 of connecting element $\mathbf{22}_8$ provides a second electrode of the first capacitive element $C_{I1}$ and air in between the two electrodes 50, 52 provides the dielectric material of the first capacitive element $C_{I1}$.

The inherent capacitances $C_{I1}$ and $C_{I2}$ effectively cancel the differential mode signals that would otherwise be induced in the pair of conductors $\mathbf{40}_4$ and $\mathbf{40}_5$ by the pair of conductors $\mathbf{40}_7$ and $\mathbf{40}_8$ and vice versa.

Figure 9:
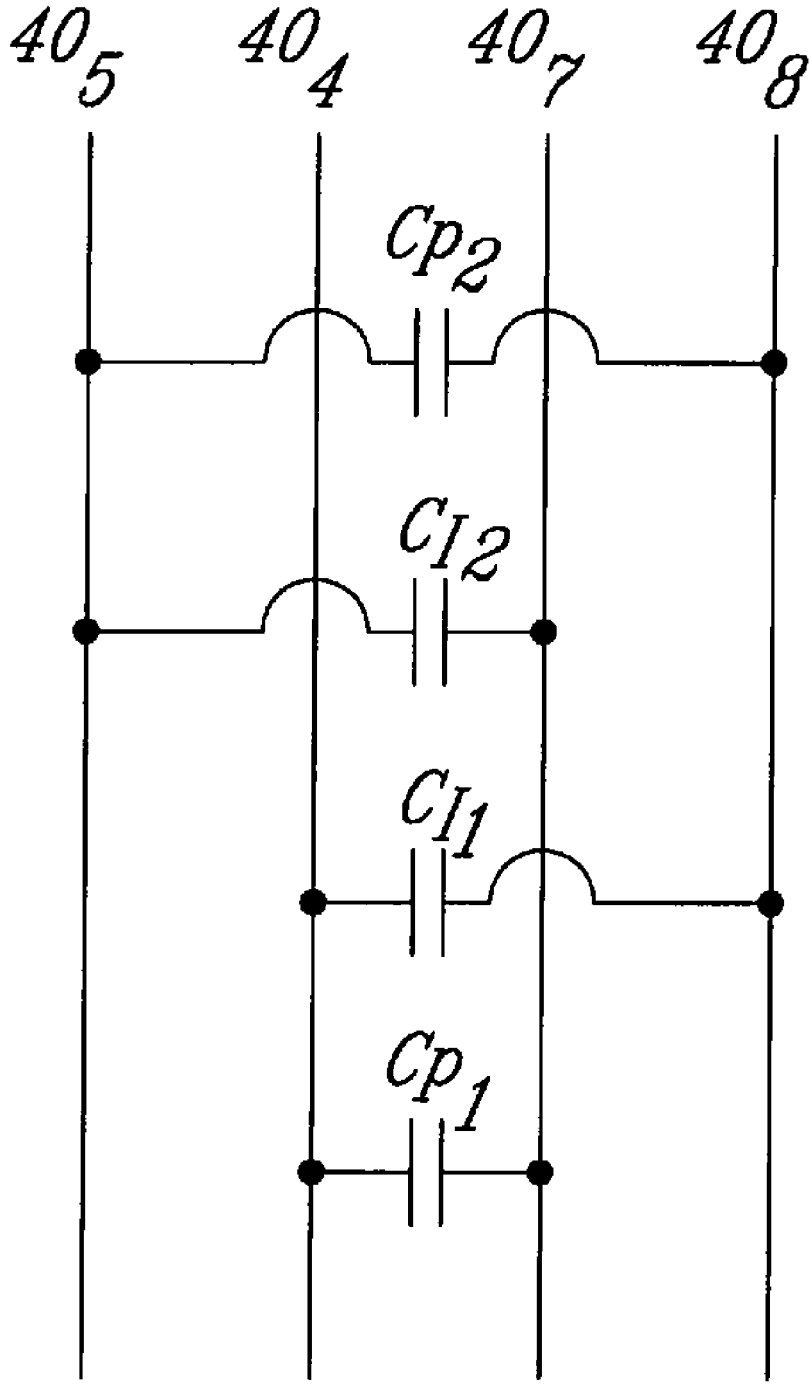
FIG. 9 is a schematic diagram of the coupling effect in accordance with an illustrative embodiment of the present invention.

This effect is illustrated in the capacitive network as shown in FIG. 9, where both components of the differential signal on the conductors $\mathbf{40}_7$ and $\mathbf{40}_8$ is coupled into each of the conductors $\mathbf{40}_4$ and $\mathbf{40}_5$, thereby effectively cancelling out the differential signal. In this manner, the inherent capacitors cancel crosstalk introduced into the conductors $\mathbf{40}_4$, $\mathbf{40}_5$, $\mathbf{40}_7$ and $\mathbf{40}_8$ terminated by, referring to FIG. 6 in addition to FIG. 9, the connecting elements as in 22 by the necessary unraveling of the twisted pairs of conductors 40 in order to insert their ends into the bifurcated IDCs 28, 30.

Figure 10:
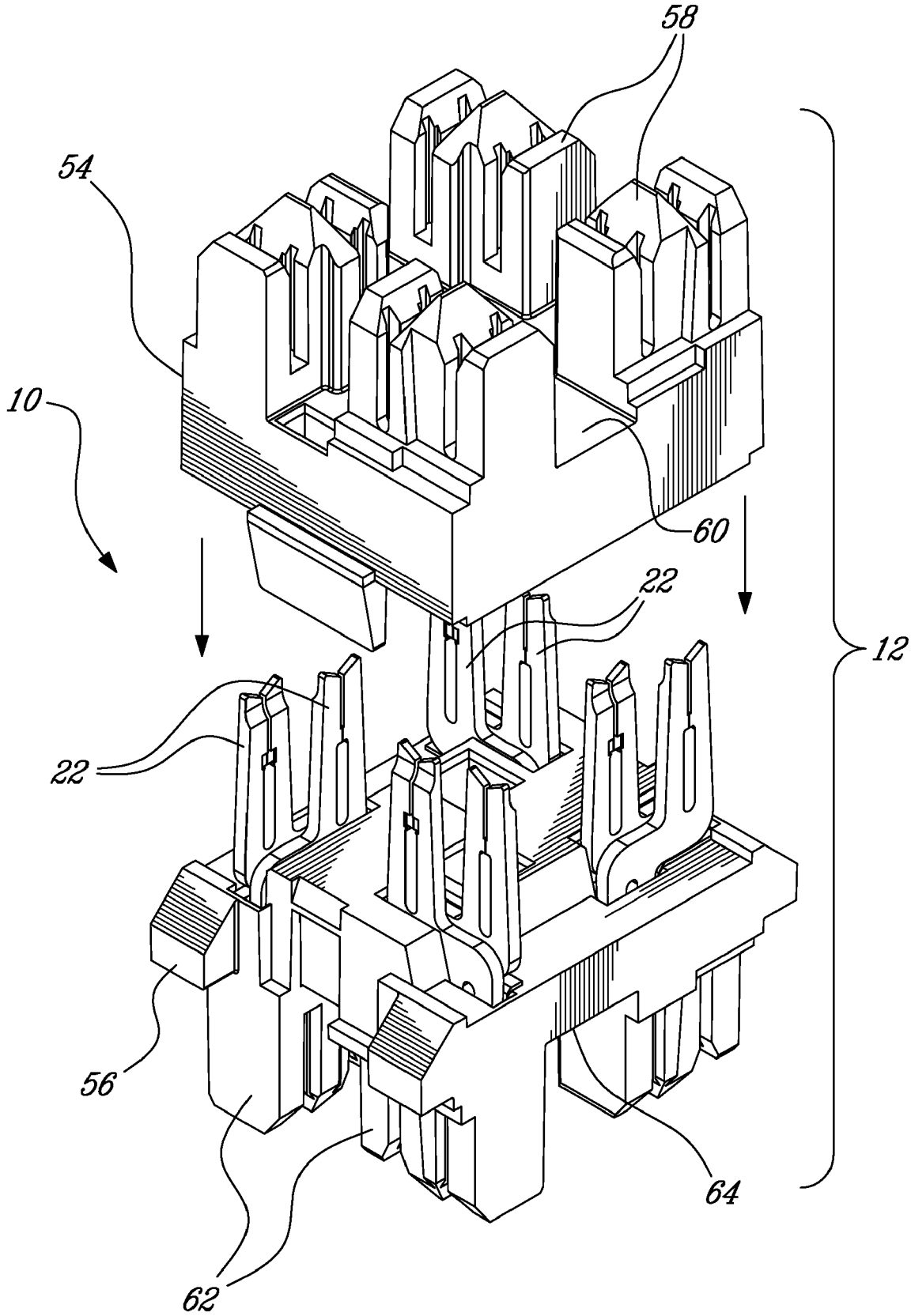
FIG. 10 is an exploded view of a balanced interconnector in accordance with an alternative illustrative embodiment of the present invention.

Referring now to FIG. 10, in an alternative illustrative embodiment of the present invention, the cross connector 10 is comprised of a housing 12 manufactured in first and second interconnecting parts 54, 56. The first interconnecting part 54 further comprises a series of turrets as in 58 illustratively arranged at the corners of the outer surface 60 of the first interconnecting part 54. Similarly, the second interconnecting part 56 also comprises a series of turrets as in 62 illustratively arranged at the corners of the outer surface 64 of the second interconnecting part 54. The substantially flat connecting elements as in 22 are arranged in pairs such that adjacent connecting elements as in 22 have their flat sides at right angles to one another. In other aspects, the alternative illustrative embodiment is similar to the first illustrative embodiment as described in detail hereinabove.

Figure 11:
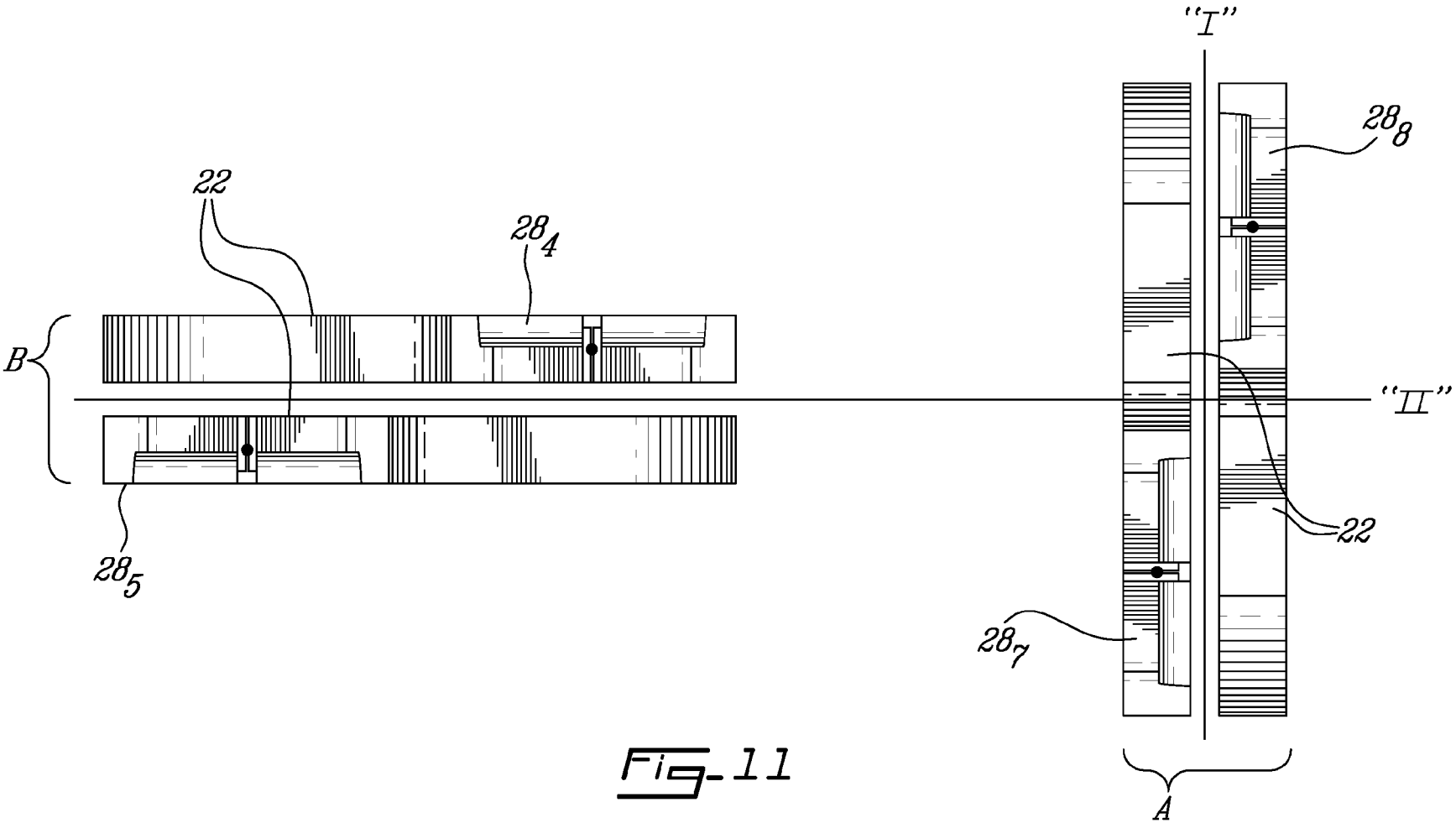
FIG. 11 is a top plan view of two pairs of connecting elements in accordance with an alternative illustrative embodiment of the present invention.

Referring now to FIG. 11, a first pair "A" of substantially flat connecting elements 22 are arranged on either side and parallel to a plane "I". Additionally, a second pair "B" of substantially flat connecting elements 22 are arranged on either side and parallel to a plane "II" which intersects plane "I" at right angles. Preferably plane "II" intersects plane "I" along a line which is coincident with the centres of the first pair A of connecting elements 22, although in a particular embodiment the line of intersection could be coincident with another point other than the center. This configuration is repeated for all four (4) pairs of connecting elements as in 22, that is each pair of connecting elements as in 22 is positioned at right angles to the adjacent pairs of connecting elements as in 22. As a result, each pair of connecting elements lies on either side of a plane which intersects that of an adjacent pair of connecting elements as in 22 and is in turn intersected by that of the other adjacent pair of connecting elements as in 22.

Figure 12A:
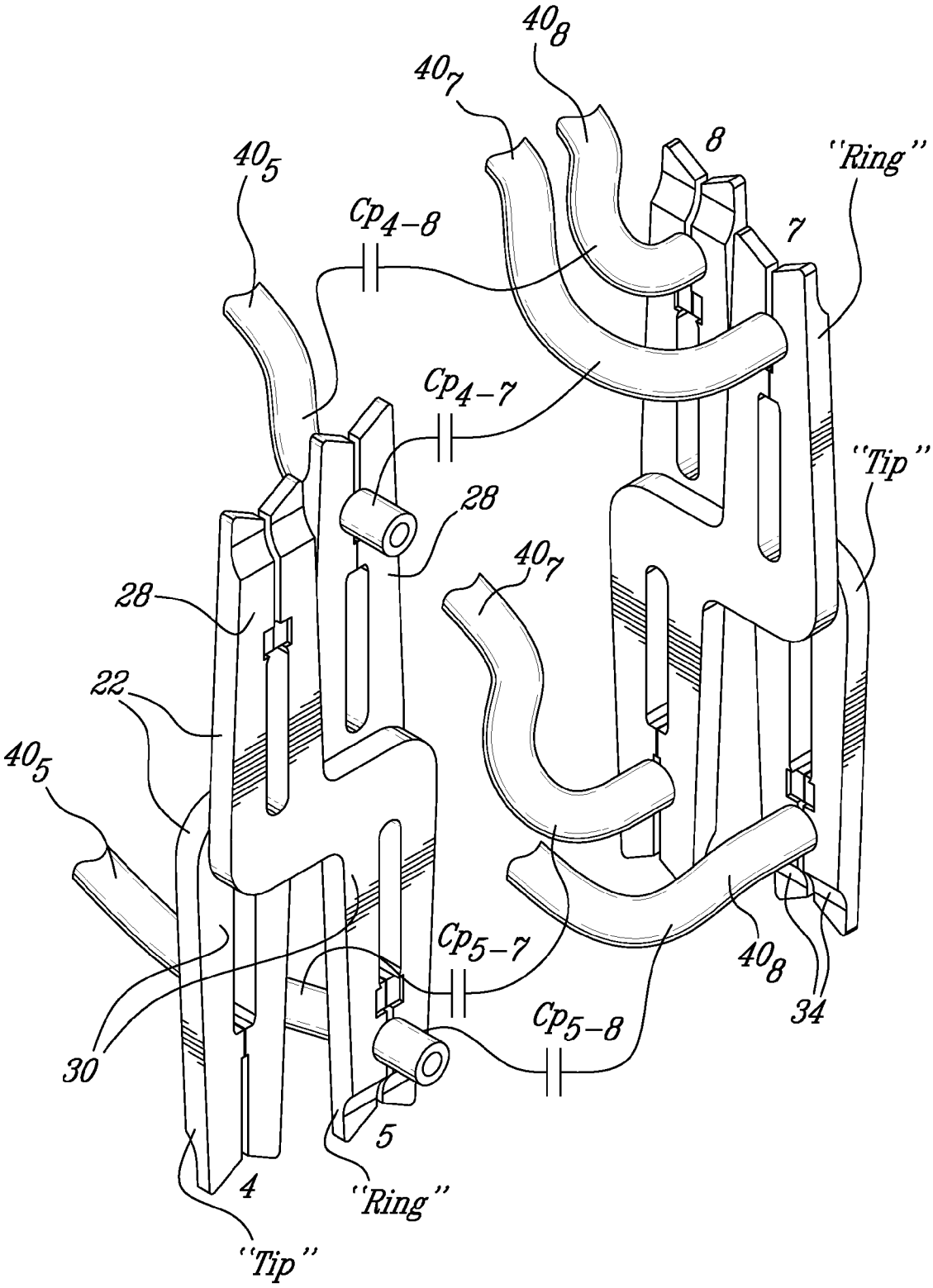
FIG. 12(*a*) is a left raised perspective view of two pairs of interconnectors in accordance with an alternative illustrative embodiment of the present invention.
Figure 12B:
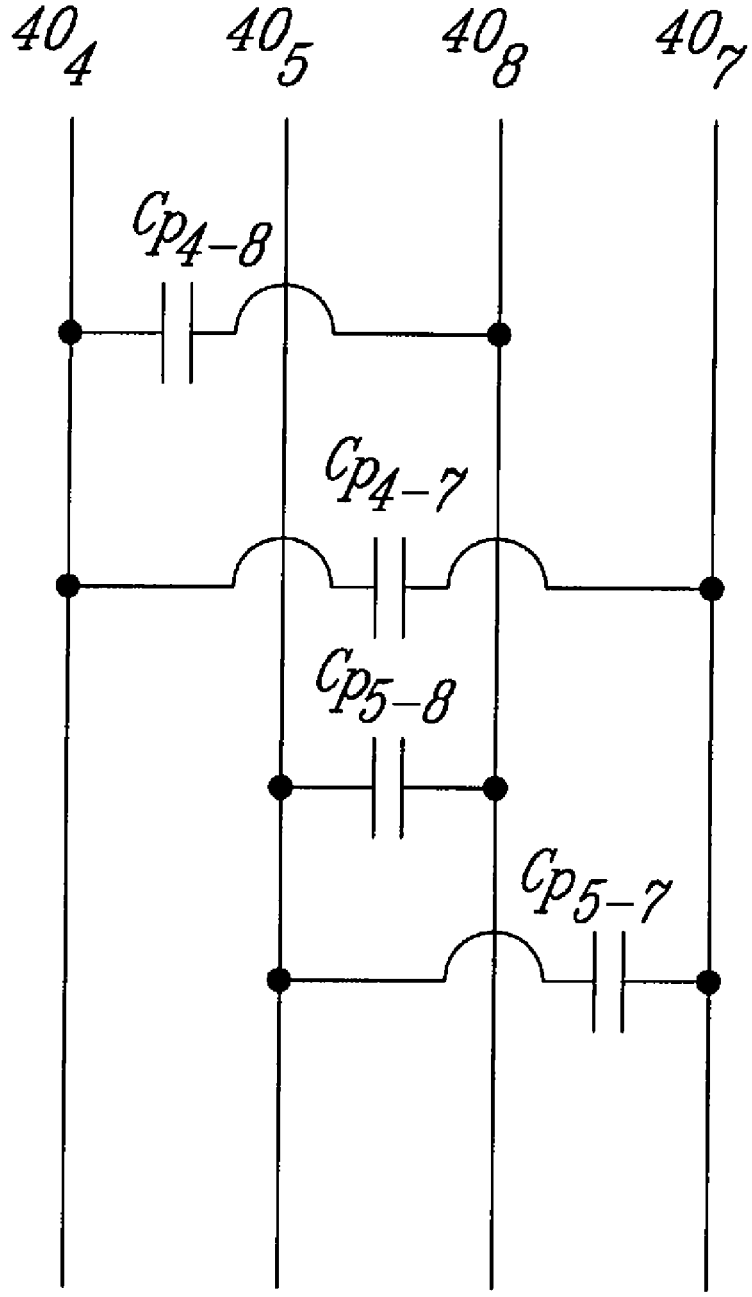
Figure 12C:
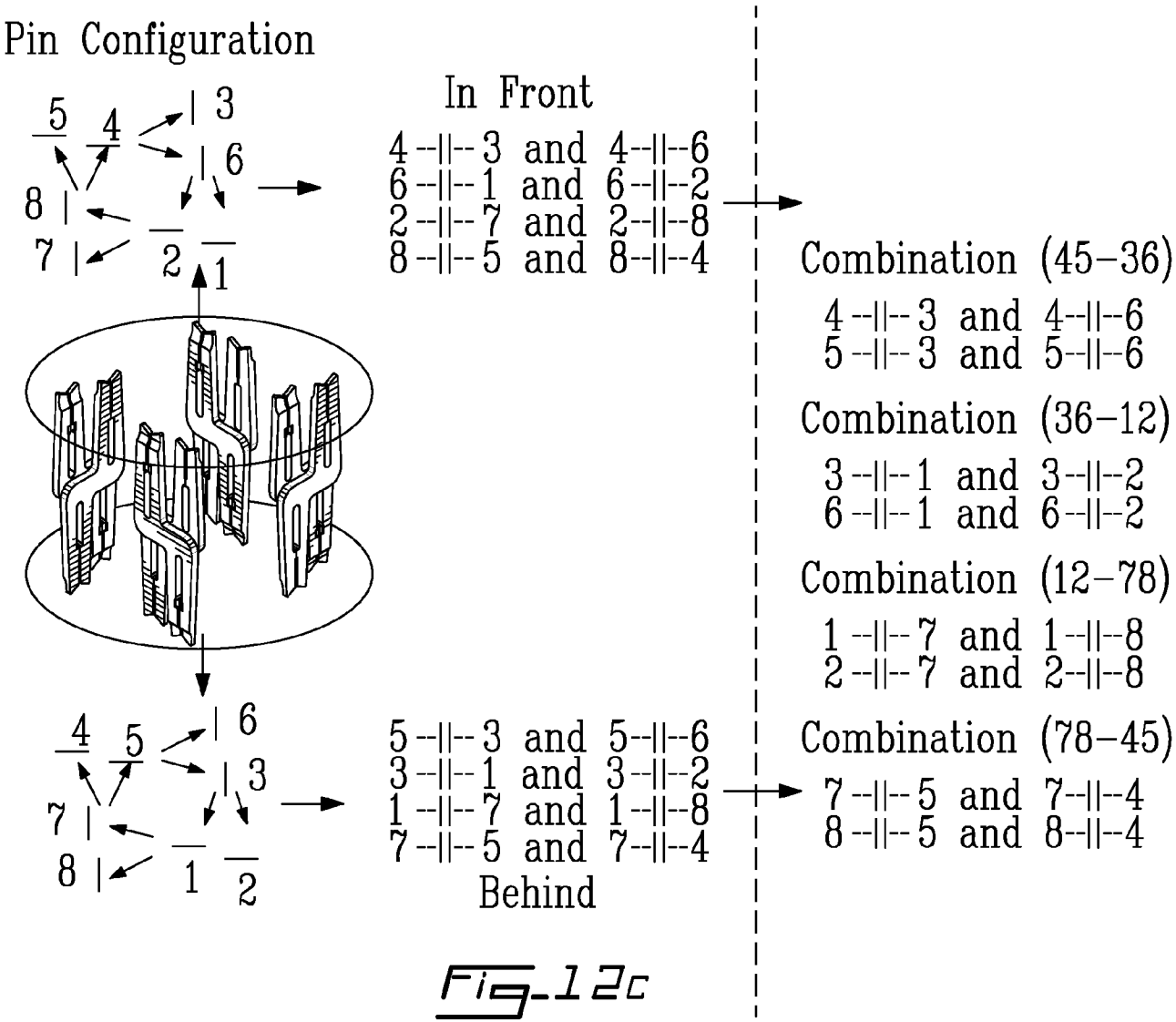

Referring now to FIG. 12(*a*), unraveling the twisted pairs of conductors 40 such that they may be inserted between the blades as in 34 of the bifurcated IDCs 28, 30 gives rise to a parasitic coupling, illustrated by capacitive elements $C_{P4\text{-}7}$, $C_{P4\text{-}8}$, $C_{P5\text{-}7}$ and $C_{P5\text{-}8}$, between the conductors as in 40 (again, illustratively the connecting elements as in 22 are indicated as terminating conductors $\mathbf{40}_4$, $\mathbf{40}_5$, $\mathbf{40}_7$ and $\mathbf{40}_8$ of the twisted pairs of conductors 40). Referring to FIG. 12(*b*) in addition to FIG. 12(*a*), due to the configuration of the parasitic capacitances $C_{P4\text{-}7}$, $C_{P4\text{-}8}$, $C_{P5\text{-}7}$ and $C_{P5\text{-}8}$, the resultant network inherently cancels differential mode to differential mode cross talk and differential mode to common mode cross talk.

As will now be apparent to a person of ordinary skill in the art, a differential signal travelling on conductors $\mathbf{40}_4$ and $\mathbf{40}_5$ will appear as equal and opposite signals on both conductors $\mathbf{40}_7$ and $\mathbf{40}_8$ which effectively cancel each other. Indeed, the positive phase of the differential signal carried on conductor $\mathbf{40}_4$ is coupled by $C_{P4\text{-}7}$ and $C_{P4\text{-}8}$ onto both conductors $\mathbf{40}_7$ and $\mathbf{40}_8$. Similarly, the negative phase of the differential signal carried on conductor $\mathbf{40}_5$ is coupled by $C_{P5\text{-}8}$ and $C_{P5\text{-}7}$ onto both conductors $\mathbf{40}_7$ and $\mathbf{40}_8$. As the parasitic capacitances are substantially equal and the lengths of the connecting elements as in 22 much less than the wavelength of the signal being transmitted (illustratively signals of 650 MHz having a wavelength of circa 0.46 meters), thereby resulting in only minimal shifts in phase, the differential signals coupled onto conductors $\mathbf{40}_7$ and $\mathbf{40}_8$ by the parasitic capacitances as cross talk will effectively cancel each other out.

Referring now to FIG. 12(*c*), given the geometric positioning of the connecting elements as in 22 relative to one another, the above parasitic coupling is repeated for all pairs of conductors terminated at the connecting elements as in 22. As a result, balancing is provided for all pairs of conductors interconnected via the four (4) pairs of connecting elements as in 22. Of note is that the balancing is provided regardless of the orientation of the conductors 40 in their interconnection with the connecting elements as in 22. That is, for example, the conductor designated 4 which as discussed above is generally referred as the Tip and conductor designated 5 which as discussed above is generally referred to as the Ring of that pair may be interchanged with one another (that is, terminated by the other connecting elements as in 22) without effecting the balancing. This applies equally to all pairs of conductors, that is as illustrated pairs 1-2, 3-6, 4-5 and 7-8.

Figure 13A:
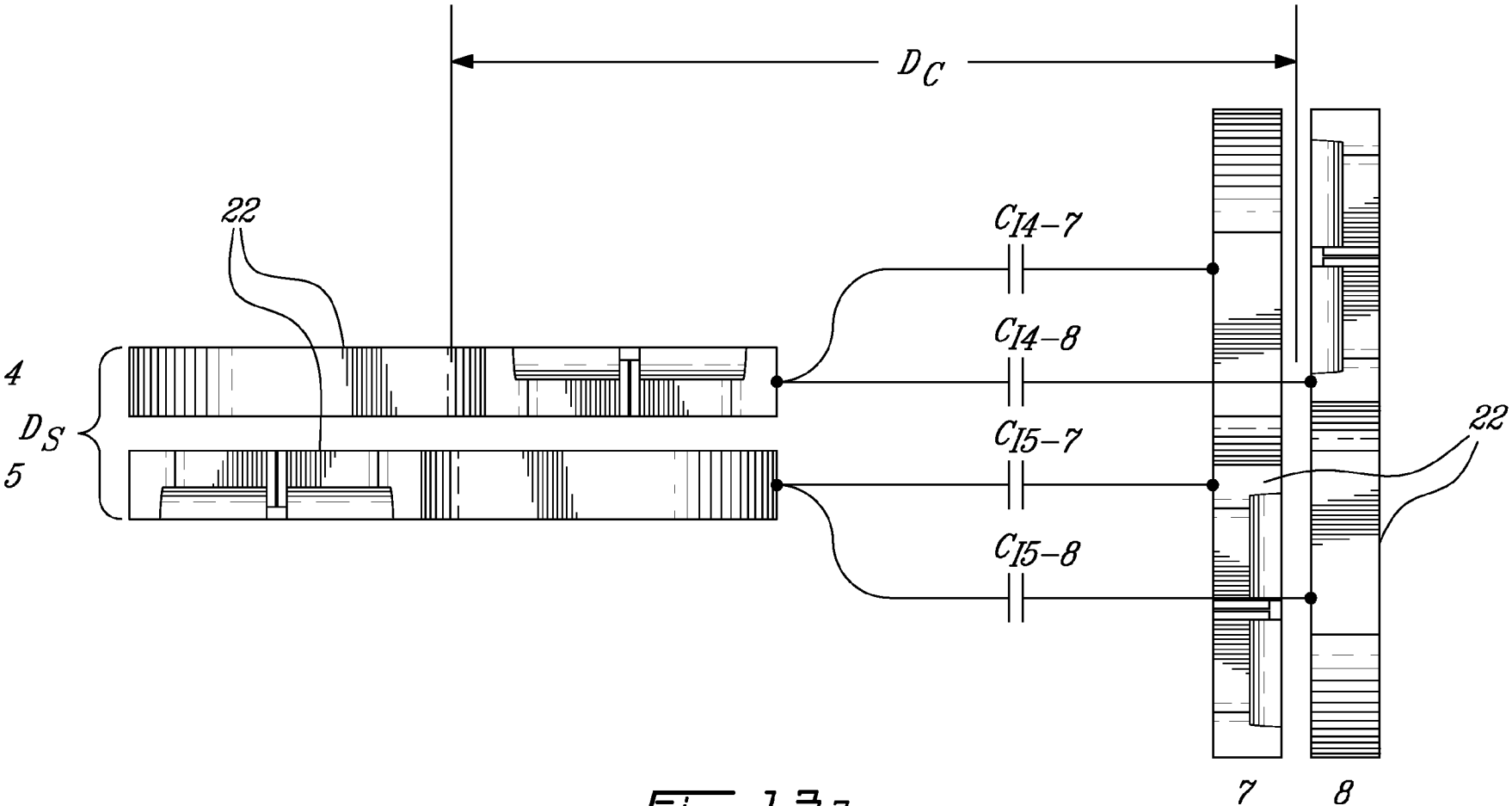
FIG. 13(*a*) is a top plan view of the two pairs of interconnectors of FIG. 12(*a*) detailing the inherent capacitances.
Figure 13B:
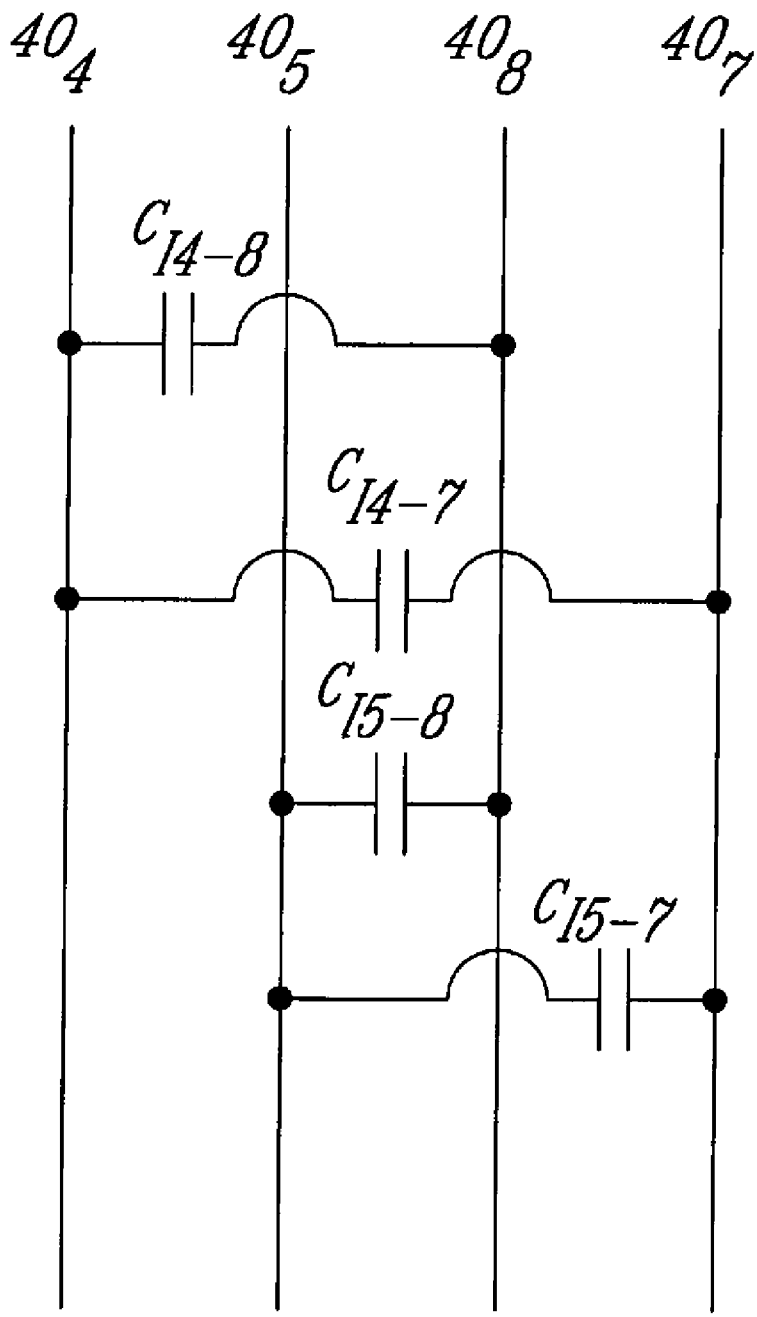

Referring now to FIG. 13(*a*), positioning of the connecting elements as in 22 also gives rise to an inherent capacitive coupling between connecting elements as in 22, illustrated by capacitive elements $C_{I4\text{-}7}$, $C_{I4\text{-}8}$, $C_{I5\text{-}7}$ and $C_{I5\text{-}8}$. Referring to FIG. 13(*b*) in addition to FIG. 13(*a*), provided distance $D_C$ between the centres of adjacent connecting elements as in 22 is substantially greater than the distance $D_S$ separating interconnectors terminating a particular pair of conductors (illustratively the distance D is about 10 times greater), these inherent capacitances are substantially equal and as a result form a capacitive network which inherently cancels differential mode to differential mode cross talk and differential mode to common mode cross talk. Of note is that the capacitive network formed by the inherent capacitances is essentially the same as that of the parasitic capacitances as discussed above in reference to FIGS. 12(*a*) through 12(*c*) and there the above discussion in reference to the parasitic capacitances can be applied to the inherent capacitances. Again, given the geometric interrelation between the connecting elements as in 22 of different pairs, a similar network of inherent capacitances is formed, depending on orientation, between adjacent pairs of connecting elements as in 22.

Figure 14A:
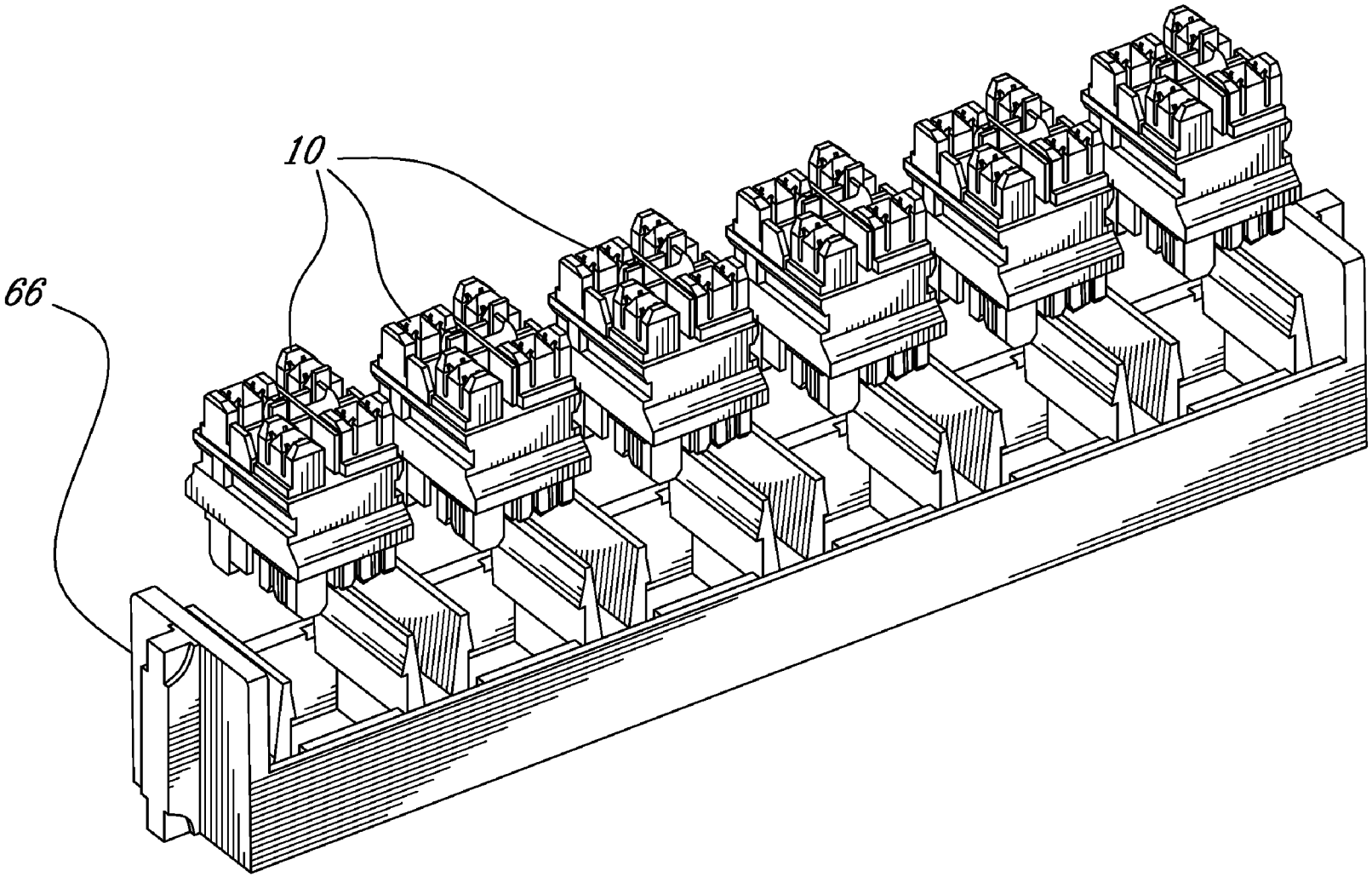
FIG. 14(*a*) is a raised perspective view of a plurality of balanced interconnectors and support frame in accordance with an alternative illustrative embodiment of the present invention.
Figure 14B:
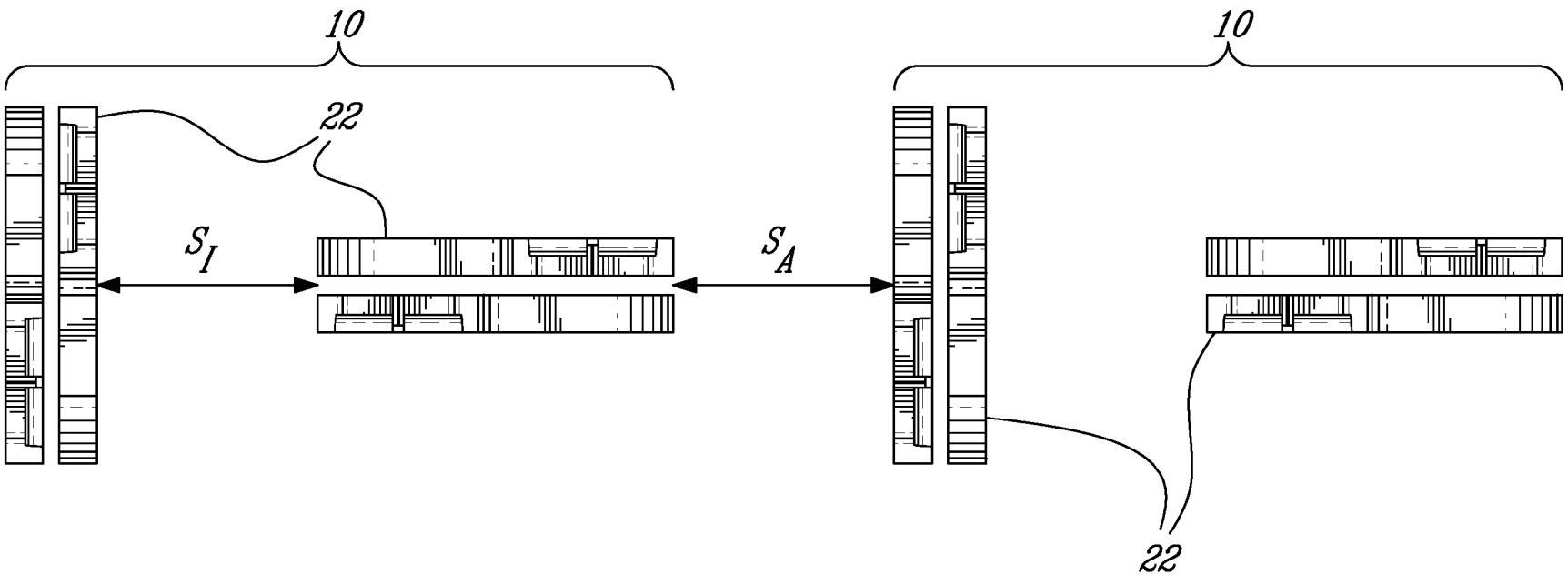

Referring now to FIG. 14(*a*), the cross connector 10 is illustratively modular and adapted for mounting, typically along with one or more like cross connectors as in 10, in a receptacle machined or otherwise formed in supporting frame 66, such as a patch bay panel or the like. In this regard, once the cross connectors as in 10 are mounted on the supporting frame, one set of turrets is exposed on each side of the supporting frame 66.

Referring now to FIG. 14(*b*) in addition to FIG. 14(*a*), provided the spacing between adjacent cross connectors as in 10 is chosen such the separation $S_A$ between pairs of connecting elements as in 22 of adjacent cross connectors as in 10 is at least the same as the separation $S_I$ between pairs of connecting elements as in 22 within a cross connector as in 10, the relative geometry between adjacent pairs of connecting elements as in 22 can be maintained between adjacent cross connector as in 10 such that the cross talk cancelling effect is achieved.

A person of skill in the art will understand that the present invention could also be used together with shielded conductors and cables, for example with the provision of a shielding cover (not shown) on the cross connector 10 manufactured for example from a conductive material and interconnected with the shielding material surrounding the conductors/cables.

Although the present invention has been described hereinabove by way of an illustrative embodiment thereof, this embodiment can be modified at will without departing from the spirit and nature of the subject invention.

What is claimed is:

1. A connector for terminating two pairs of conductors, the connector comprising:

first and second pairs of elongate terminals, each of said terminal pairs terminating a respective one of the pairs of conductors, each of said first pair of terminals arranged substantially in parallel to and substantially equidistant from a first plane and each of said second pair of terminals arranged substantially in parallel to and substantially equidistant from a second plane at right angles to said first plane, said first plane intersecting said second plane substantially at right angles along a line of intersection substantially in parallel to each of said first and second terminal pairs;

wherein when viewed transversely, a first distance between a first terminal of said first terminal pair and a first terminal of said second terminal pair is less than a second distance between said first terminal of said first terminal pair and a second terminal of said second terminal pair and a third distance between a second terminal of said first terminal pair and said first terminal of said second terminal pair is less than a fourth distance between said second terminal of said first terminal pair and said second terminal of said second terminal pair.

2. The connector of claim 1, wherein said terminals are substantially flat IDCs, each said first pair of IDCs substantially in parallel to and equidistant from said first plane and each said second pair of IDCs comprising a surface substantially in parallel to and equidistant from said second plane.

3. The connector of claim 1, wherein said first plane intersects said second plane along a line of intersection in parallel to and equidistant from each of said second terminal pair.

4. The connector of claim 1, wherein a distance between each of said first terminal pair is substantially the same as a distance between each of said second terminal pair.

5. The connector of claim 1, wherein said first distance is substantially the same as said fourth distance.

6. An interconnector for interconnecting a first set of two pairs of conductors with a second set of two pairs of conductors, the interconnector comprising:

a non conductive housing comprising a first outer surface and a second outer surface; and at least two pairs of like conducting elements, each element of each of said pairs comprising an elongate terminal at opposite first and second ends thereof, said terminals generally parallel and non-collinear, said terminals at said first ends for receiving a respective one of the first set of conductors and said terminals at said second ends for receiving a respective one of the second set of conductors;

wherein said elements of a first of said pairs lie on either side of a first plane and are arranged opposite one another as a reverse mirror image, wherein said elements of a second of said pairs lie on either side of a second plane and are arranged opposite one another as a reverse mirror image and wherein said first plane intersects said second plane at right angles along a first line of intersection which is parallel to said elongate terminals;

wherein at least a portion of each of said terminals at said first element ends are exposed on said first surface and at least a portion of each of said terminals at said second element ends are exposed on said second surface.

7. The interconnector of claim 6, wherein said second outer surface is on an opposite side of said housing from said first outer surface and wherein said first surface and said second surface are substantially parallel.

8. The interconnector of claim 6, wherein a distance $D_S$ separating centres of said first pair of elements is less than about 20% of a distance $D_C$ separating said first pair centres and said second plane.

9. The interconnector of claim 8, wherein said distance $D_S$ is less than about 10% of said distance $D_C$.

10. The interconnector of claim 6, wherein said terminals are IDCs.

11. The interconnector of claim 6, wherein each of said elements comprises an elongate connecting portion between said terminals, said connecting portion arranged substantially at right angles to said terminals.

12. The interconnector of claim 6, wherein said first line of intersection is substantially in a center of said second connector pair.

13. The interconnector of claim 12, wherein said elements of a third of said pairs lie on either side of a third plane and are arranged opposite one another as a reverse mirror image, wherein said elements of a fourth of said pairs lie on either side of a fourth plane and are arranged opposite one another as a reverse mirror image, wherein said second plane intersects said third plane at right angles along a second line of intersection which is parallel to said elongate terminals and substantially in a center of said third connector pair, wherein said third plane intersects said fourth plane at right angles along a third line of intersection which is parallel to said elongate terminals and substantially in a center of said fourth pair and wherein said fourth plane intersects said first plane at right angles along a line of intersection which is parallel to said elongate terminals and substantially in a center of said first pair.

14. The interconnector of claim 6, wherein the pairs of conductors are twisted pairs of conductors.

15. The interconnector of claim 6, wherein the first set of two pairs of conductors are encased within a first cable jacket and the second set of two pairs of conductors are encased within a second cable jacket.

16. An interconnector for interconnecting a first cable comprising four twisted pairs of conductors with a second cable comprising four twisted pairs of conductors, the interconnector comprising:

a non conductive housing comprising a first outer surface and a second outer surface; and first, second, third and fourth pairs of like conducting connecting elements, each element of a given one of said pairs of elements comprising an elongate terminal at opposite first and second ends thereof, said terminals substantially parallel and non-collinear and adapted to receive a respective one of the conductors wherein each element of said given pair lies in a different plane and wherein a first element of said given pair is arranged opposite a second element of said given pair as a reverse mirror image;

wherein a first element of said first pair and a first element of said second pair lie in a first plane, a second element of said first pair and a second element of said second pair lie in a second plane, a first element of said third pair and a first element of said fourth pair lie in a third plane and a second element of said third pair and a second element of said fourth pair lie in a fourth plane and further wherein at least a portion of each of said terminals at said first ends is exposed on said first outer surface and at least a portion of each of said terminals at said second ends is exposed on said second outer surface.

17. The interconnector of claim 16, wherein said second outer surface is on an opposite side of said housing from said first outer surface and wherein said first surface and said second surface are substantially parallel.

18. The interconnector of claim 16, wherein said first outer surface and said second outer surface are substantially flat.

19. The interconnector of claim 16, wherein said terminals are IDCs.

20. The interconnector of claim 16, wherein each of said connecting elements comprises an elongate connecting portion between said terminals, said connecting portion arranged substantially at right angles to said terminals.

21. An interconnection between a first set of two pairs of conductors and a second set of two pairs of conductors, the interconnection comprising:

first and second pairs of like elongate connecting elements, a first end of each of said first pair of elements connected to a respective one of a first pair of the first set of pairs of conductors, a second end of each of said first pair of elements connected to a respective one of a first pair of the second set of pairs of conductors, a first end of each of said second pair of elements connected to a respective one of a second pair of the first set of pairs of conductors, and a second end of each of said second pair of elements connected to a respective one of a second pair of the second set of pairs of conductors; and a first capacitor connected between a first element of said first pair and a first element of said second pair, a second capacitor connected between a first element of said first pair and a second element of said second pair, a third capacitor connected between a second element of said first pair and a first element of said second pair, and a fourth capacitor connected between a second element of said first pair and a second element of said second pair;

wherein said capacitors have a capacitive value which is substantially equal.

22. The interconnection of claim 21, wherein each of said elements comprises a first terminal positioned towards a first end and a second terminal positioned towards a second end and further wherein each conductor of the first set of conductors is terminated at a respective one of said first terminals and each conductor of the second set of conductors is terminated at a respective one of said second terminals.

23. The interconnection of claim 22, wherein each pair of the first set of two pairs of conductors and the second set of two pairs of conductors is a twisted pair of conductors and further wherein each of said terminals comprises an IDC.

24. The interconnection of claim 22, wherein each of said terminals is elongate and further wherein each of said terminals is arranged along parallel non-collinear axes.

25. The interconnection of claim 24, wherein each of said elements comprises an elongate connecting portion between said terminals, said connecting portion arranged substantially at right angles to said terminals.

26. The interconnection of claim 24, wherein each pair of the pairs of conductors comprises a Ring and a Tip, wherein each pair of elements is comprised of a Tip element and a Ring element, each of said Tip elements interconnecting a respective Tip of said first set of conductors with a respective Tip of said second set of conductors and each of said Ring elements interconnecting a respective Ring of said first set of conductors with a respective Ring of said second set of conductors and further wherein each of said Tip elements lie in a first plane and each of said Ring elements lie in a second plane displaced from said first plane.

27. The interconnection of claim 26, wherein for each pair of elements, said Tip element is arranged opposite said Ring element as a reverse mirror image.

28. The interconnection of claim 21, wherein each pair of the pairs of conductors comprises a Ring and a Tip, wherein each pair of elements is comprised of a Tip element and a Ring element, each of said Tip elements interconnecting a respective Tip of said first set of conductors with a respective Tip of said second set of conductors and each of said Ring elements interconnecting a respective Ring of said first set of conductors with a respective Ring of said second set of conductors.

29. The interconnection of claim 28, wherein said first capacitive coupling is between said Ring element of said first pair of elements and said Tip element of said second pair of elements, said second capacitive coupling is between said Ring element of said second pair of elements and said Tip element of said first pair of elements, said third capacitive coupling is between said Tip element of said first pair of elements and said Tip element of said second pair of elements, and said fourth capacitive coupling is between said Ring element of said first pair of elements and said Ring element of said second pair of elements.

* * * * *